US007165944B2

(12) United States Patent
Gautreau et al.

(10) Patent No.: US 7,165,944 B2
(45) **Date of Patent: *Jan. 23, 2007**

(54) COMPRESSOR BLADE WITH DOVETAIL SLOTTED TO REDUCE STRESS ON THE AIRFOIL LEADING EDGE

(75) Inventors: James Charles Gautreau, Greenville, SC (US); Nicholas Francis Martin, Simpsonville, SC (US); Chris A. Rickert, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/038,038

(22) Filed: Jan. 21, 2005

(65) Prior Publication Data

US 2005/0249592 A1 Nov. 10, 2005

Related U.S. Application Data

(63) Continuation of application No. 10/327,949, filed on Dec. 26, 2002, now Pat. No. 6,902,376.

(51) Int. Cl.
*F01D 5/16* (2006.01)

(52) U.S. Cl. ..... 416/219 R; 416/239; 416/248; 416/500

(58) Field of Classification Search ..... 416/219 R, 416/220 R, 221, 248, 500, 239
See application file for complete search history.

(56) References Cited

U.S. PATENT DOCUMENTS 2,913,221 A 11/1959 Klint et al.
2,994,507 A * 8/1961 Keller et al. ..... 416/221
3,656,865 A * 4/1972 Spears, Jr. ..... 416/221
4,221,542 A * 9/1980 Acres et al. ..... 416/220 R
4,480,957 A 11/1984 Patel et al.
4,682,935 A 7/1987 Martin
4,872,810 A 10/1989 Brown et al.
5,123,813 A 6/1992 Przytulski et al.
5,156,528 A 10/1992 Bobo
5,205,713 A 4/1993 Szpunar et al.
5,244,345 A 9/1993 Curtis
5,256,035 A 10/1993 Norris et al.
5,277,548 A 1/1994 Klein et al.
5,536,143 A 7/1996 Jacala et al.
5,573,377 A 11/1996 Bond et al.
5,582,077 A 12/1996 Agram et al.
5,743,708 A 4/1998 Cunha et al.
5,924,843 A 7/1999 Staub et al.
5,947,687 A 9/1999 Mori et al.
5,988,980 A 11/1999 Busbey et al.
6,033,185 A 3/2000 Lammas et al.
6,065,938 A * 5/2000 Bartsch ..... 416/219 R (Continued)

FOREIGN PATENT DOCUMENTS

CH 660 207 A5 3/1987

(Continued)

*Primary Examiner*—Richard A. Edgar
(74) *Attorney, Agent, or Firm*—Nixon & Vanderhye P.C.

(57) ABSTRACT

A blade of an axial compressor comprising: an airfoil is disclosed that has a leading edge and a root; a platform attached to the root of the airfoil; a dovetail attached to a side of the platform opposite to the airfoil; a neck of the dovetail adjacent the platform, and a slot in the neck and generally parallel to the platform, and the slot extends from a front of the neck to position in the neck beyond a line formed by the leading edge of the blade.

39 Claims, 3 Drawing Sheets

U.S. PATENT DOCUMENTS

| | | | |
|---|---|---|---|
| 6,095,750 | A | 8/2000 | Ross et al. |
| 6,132,174 | A | 10/2000 | Staub et al. |
| 6,190,131 | B1 | 2/2001 | Deallenbach |
| 6,390,775 | B1 | 5/2002 | Paz |
| 6,402,471 | B1 | 6/2002 | Demers et al. |
| 6,419,753 | B1 | 7/2002 | Wheat et al. |
| 6,457,942 | B1 | 10/2002 | Forrester |
| 6,478,537 | B1 | 11/2002 | Junkin |
| 6,481,967 | B1 | 11/2002 | Tomita et al. |
| 6,520,836 | B1 | 2/2003 | Dean et al. |
| 6,752,594 | B1 | 6/2004 | Miller et al. |
| 6,769,877 | B1 | 8/2004 | Martin et al. |
| 6,902,376 | B1 | 6/2005 | Gautreau et al. |
| 2002/0081205 | A1 | 6/2002 | Wong |

FOREIGN PATENT DOCUMENTS

| | | |
|---|---|---|
| GB | 906476 | 9/1962 |
| GB | 1190771 | 5/1970 |
| JP | 51127302 A | 11/1976 |
| JP | 57076208 A | 5/1982 |
| JP | 57186004 A | 11/1982 |

* cited by examiner

COMPRESSOR BLADE WITH DOVETAIL SLOTTED TO REDUCE STRESS ON THE AIRFOIL LEADING EDGE

RELATED APPLICATION

This application is a continuation of U.S. patent application Ser. No. 10/327,949 (now U.S. Pat. No. 6,902,376) filed Dec. 26, 2002, and the entirety of which is incorporated by reference.

BACKGROUND OF THE INVENTION

The invention relates to compressor blades and, in particular, to leading edge treatments to increase blade tolerance to erosion.

Water is sprayed in a compressor to wash the blades and improve performance of the compressor. Water washes are used to clean the compressor flow path especially in large industrial gas turbines, such as those used by utilities to generate electricity. Water is sprayed directly into the inlet to the compressor uniformly across the flow path.

Water sprayed on the hub hits the blades of the first stage of the compressor. These rotating first stage blades shower water radially outward into the flow path of the compressor. The water is carried by the compressor air through the compressor vanes and blades. The water cleans the compressor and vane surfaces. However, the impact of the water on the first stage blades tends to erode the leading edge of those blades especially at their roots, which is where the blade airfoil attaches to the blade platform.

Erosion can pit, crevice or otherwise deform the leading edge surface of the blade. Erosion often starts with an incubation period during which the blade, e.g., a new blade, is pitted and crevices form in the blade leading edge. As erosion continues, the population of pits and crevices increases and they deepen into the blade.

The blade is under tremendous stress due to centrifugal forces and vibration due to the airflow and the compressor machine. These stresses tear at the pit and crevices and lead to a high cycle fatigue (HCF) crack in the blade. Once a crack develops, the high steady state stresses due to the centrifugal forces that act on a blade and the normal vibratory stresses on the blade can cause the crack to propagate through the blade and eventually cause the blade to fail. A cracked blade can fail catastrophically by breaking into pieces that flow downstream through the compressor and cause extensive damage to other blades and the rotor. Accordingly, there is a long felt need to reduce the potential of cracks forming in compressor blades due to blade erosion.

BRIEF DESCRIPTION OF THE INVENTION

In one embodiment, the invention is a blade of an axial compressor comprising: an airfoil having a leading edge and a root; a platform attached to the root of the airfoil; a dovetail attached to a side of the platform opposite to the airfoil; a neck of the dovetail adjacent the platform, and a slot in the neck and generally parallel to the platform, where said slot extends from a front of the neck to a position in the neck beyond a line formed by the leading edge of the blade. Further, the slot may extend a width of the neck, and is a key-hole shaped slot.

The slot may have a narrow gap extending from the front of the neck and extending to a cylindrical aperture portion of the slot. The cylindrical aperture has an axis that is offset from said slot narrow gap. In addition, an insert shaped to fit snugly in said slot may be inserted into the slot during installation of the compressor blade. The insert may have a narrow rectangular section attached to a cylindrical section, where the insert fits in the slot.

In a second embodiment, the invention is a method for unloading centrifugal stresses from a leading edge of an airfoil of a compressor blade having a platform and a dovetail, the method comprising: generating a slot in the dovetail below a front portion of the platform, wherein the slot underlies the leading edge of the airfoil; forming a cylindrical aperture at an end of the slot, wherein said cylindrical aperture is generally parallel to the platform and extends through the dovetail, and by generating the slot with the cylindrical, reducing centrifugal and vibratory load on at least the root of the leading. The blade may be a first stage compressor blade.

In this method, the slot extends the width of the neck and is generated as a key-hole shaped slot. Further, the slot is generated by cutting a narrow gap into a front of the neck and said cylindrical aperture formed at a rear of the narrow gap by drilling through the neck. Alternatively, the slot is generated while casting the dovetail. An insert may be slid into the slot, where the insert substantially fills the slot.

In a third embodiment, the invention is a blade of an axial compressor comprising: an airfoil having a leading edge and a root; a platform attached to the root of the airfoil; a dovetail attached to a side of the platform opposite to the airfoil, and a neck of the dovetail adjacent the platform, wherein a corner of the neck aligned with the leading edge of the blade is not attached to a portion of the platform opposite to the leading edge of the blade. The corner region of the neck portion may be a conical quarter section with a rounded surface and the corner region is joined to the platform via a fillet.

DETAILED DESCRIPTION OF THE INVENTION

To increase blade tolerance to erosion, the geometry of the first stage compressor blade has been modified to reduce the stresses acting on the leading edge of a blade. The tremendous centrifugal and vibratory stresses that act on a blade can cause small pits and surface roughness to initiate a crack leading to blade failure.

Figure 1:
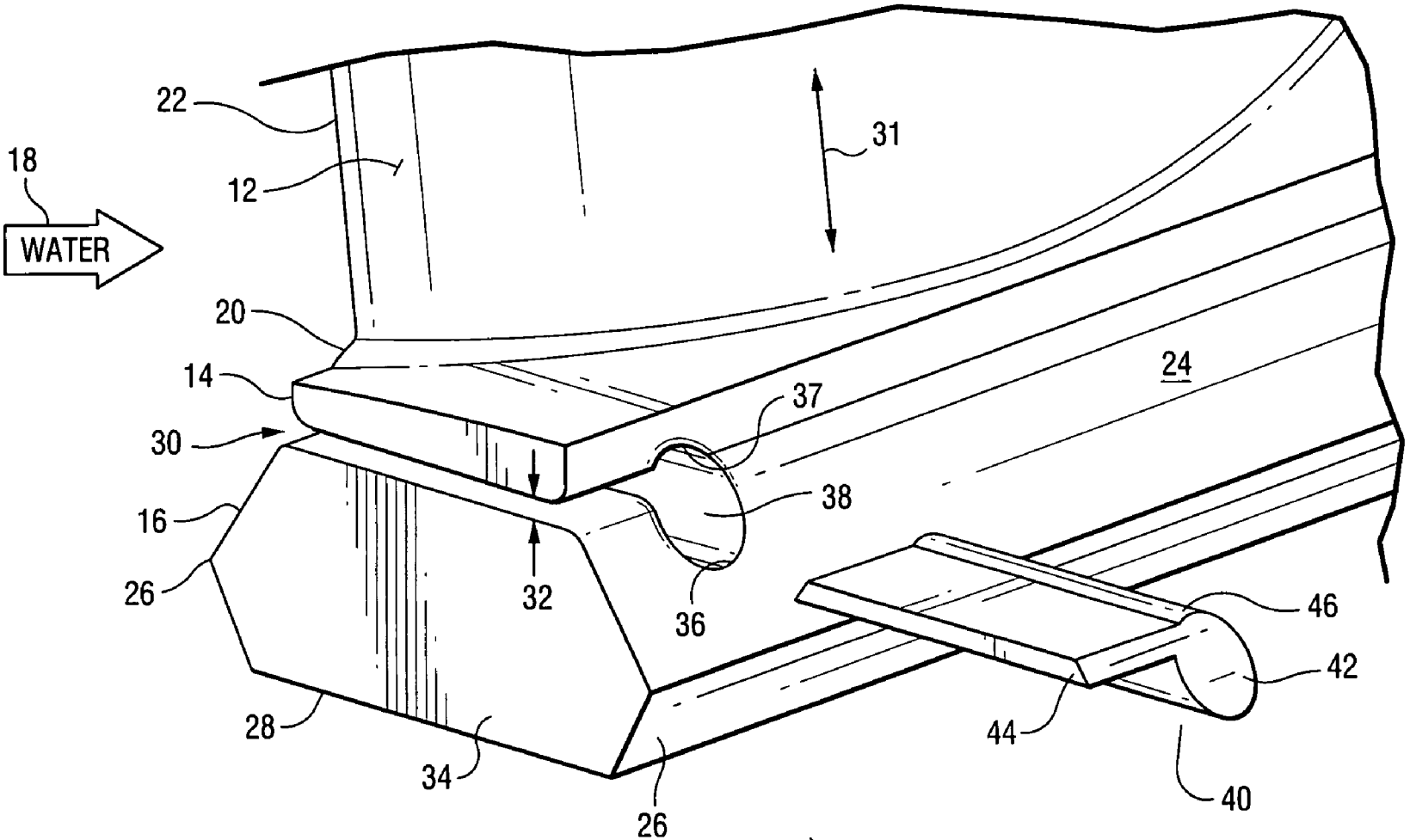
FIG. 1 is an enlarged perspective view of portion of a compressor blade having a slot in its dovetail connector, and an insert for the slot.
Figure 2:
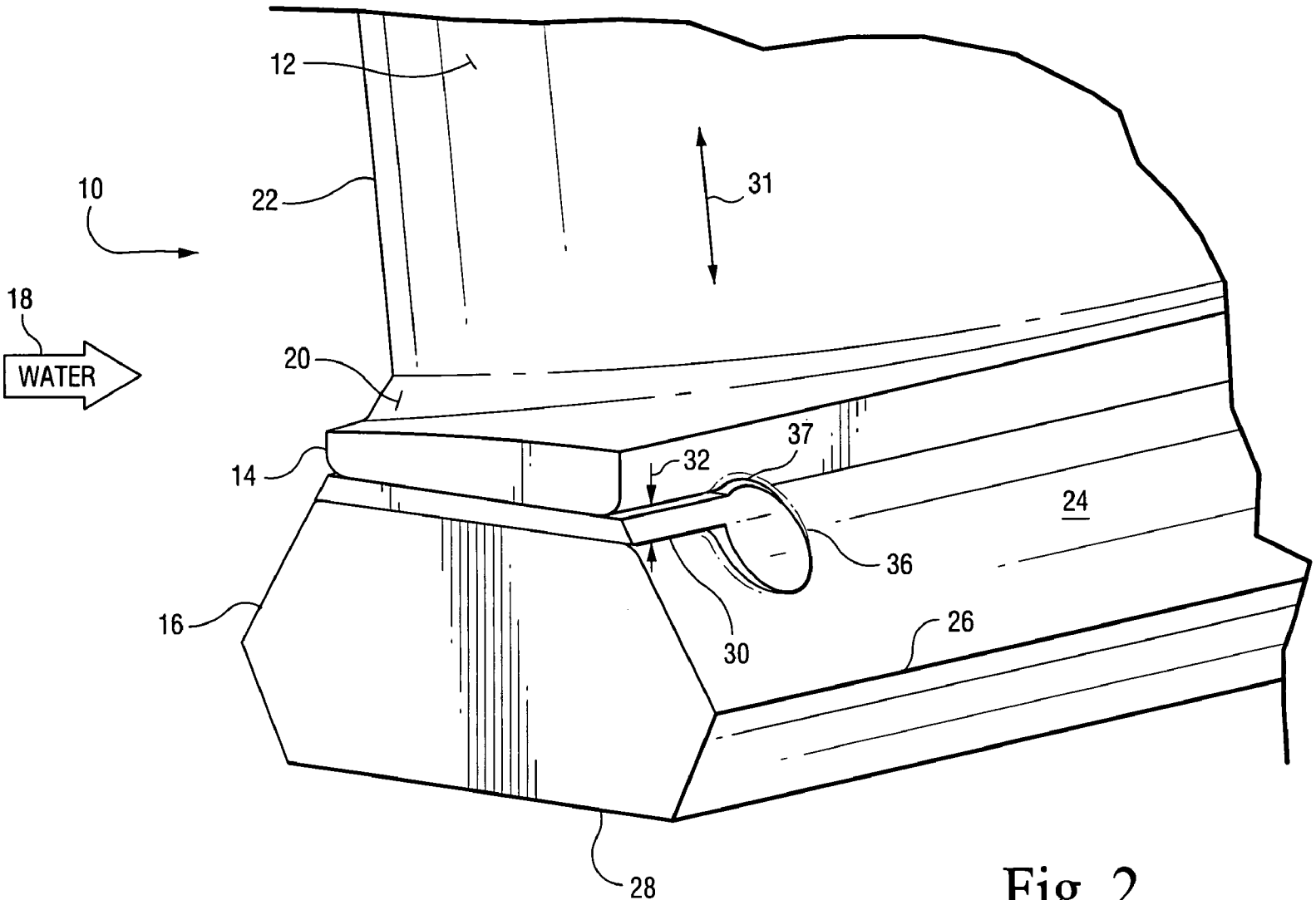
FIG. 2 is an enlarged perspective view of the base of a compressor blade shown in FIG. 1 with the insert in the slot.

FIGS. 1 and 2 show a portion of a first stage blade 10 of a multistage axial compressor of an industrial gas turbine engine, such as used for electrical power generation. The compressor blade includes a blade airfoil 12, a platform 14 at the root 20 of the blade, and a dovetail 16 that is used to connect the blade to a compressor disk (not shown). The dovetail 16 attaches the blade to the rim of the disk. An array of compressor blades are arranged around the perimeter of the disk to form an annular row of blades.

During an on-line water wash, water 18 is uniformly sprayed into the compressor. Large water droplets tend to hit a lower portion of the airfoil surface 12 of the blade, which is near the root 20 of the blade.

Air flows over the airfoil surface 12 of the row of compressor blades in each stage of the compressor. The shape and surface roughness of the airfoil surface are important to the aerodynamic performance of the blades and the compressor. Large water droplets hitting the leading edge 22 of the first stage blades can erode, pit and roughen the airfoil surface 12.

The platform 14 of the blade is integrally joined to the root 20 of the airfoil 12. The platform defines the radially inner boundary of the air flow path across the blade surface from which extends the blade airfoil 12. An opposite side of the platform is attached to the dovetail connector 16 for the blade.

The dovetail 16 fits loosely in the compressor disk until the rotor spins and then centrifugal forces push the dovetail firmly radially upward against a slot in the disk. The force of the disk on the dovetail connector counteracts the centrifugal forces acting on the rotating blade. These opposite forces create stresses in the blade airfoil 12. The stresses are concentrated in the blade at certain locations, such as where the root 20 of the blade is attached to the platform 14.

The dovetail 16 has a neck region 24 just below the platform, a wide section 26 with lobes that engage a slot in the disk perimeter, and a bottom 28. A slot 30 extends through the neck below the platform. The slot is perpendicular to the axis 32 of the blade and is generally parallel to the platform. The slot 30 is cut into the dovetail neck 24 below the platform and beneath the leading edge 22 of the blade airfoil 12. The slot extends the width of the neck of the dovetail. The slot has a generally key-hole shape with a narrow gap 32 starting at the front of the dovetail and extending underneath the leading edge of the airfoil blade. The end of the slot expands into a generally cylindrical section 36 having a generous radius to reduce stresses caused by the slot on the dovetail. The cylindrical section 36 intersects with the narrow gap 32 of the slot such that the axis 38 of the cylinder is slightly below the centerline of the gap 32. The upper surface of the slot and cylinder (which is the lower surface of the front portion of the platform) is generally flat except for a slight recess 37 corresponding an upper ridge 46 of a cylinder insert 40. The slot may be formed by machining, such as by cutting the narrow gap 32 and by drilling out the cylindrical aperture 36. Alternatively, the slot 30 may be formed with the casting of the dovetail.

The slot 30 in the dovetail reduces the stress applied to the leading edge 22 of the airfoil, especially at the root 20 where the airfoil attaches to the platform 14. Stress reduction occurs because the front of the platform is disconnected from the dovetail directly. The front of the platform extends as a cantilever beam over the dovetail. Because the front of the platform is not directly attached to the underlying dovetail, the stress is reduced due to centrifugal forces that would otherwise pass from the dovetail, through the front of the platform and to the leading edge of the airfoil. Due to the reduction of stress on the leading edge 22 of the root 20 of the blade airfoil, the likelihood is reduced that erosion induced pits and other surface defects will propagate into cracks. Accordingly, the slot 30 through the dovetail should significantly reduce the risk of HCF cracks emanating from erosion damage at the lower section of the leading edge of a blade.

An insert 40 is fitted into the slot 30. The insert is show in FIG. 1 as separated from the slot and in FIG. 2 is shown as inserted into the slot. The insert has a shape similar to that of the slot. The insert is a non-metallic component that fits snugly into the slot. The insert reduces the potential of acoustic resonance in the cavity of the slot. The insert also prevents dirt, water and other debris from accumulating in the slot. The insert does not transmit centrifugal stresses from the dovetail to the leading edge of the blade via the platform. The insert has a cylinder portion 42 that fits into the cylinder aperture 36 of the slot. The insert has a rectangular portion 44 that extends from the cylinder and fits in the narrow section 32 of the slot 30. The upper ridge 46 of the cylinder 42 may protrude slightly up from the rectangular portion 44 of the insert.

In an alternative embodiment, the cut-away section is a block extends across the entire front of the dovetail. This alternative embodiment is the subject of another application, which is U.S. patent application Ser. No. 10/065,453 that is commonly-owned with the present application and shares at least one common inventor.

Figure 3:
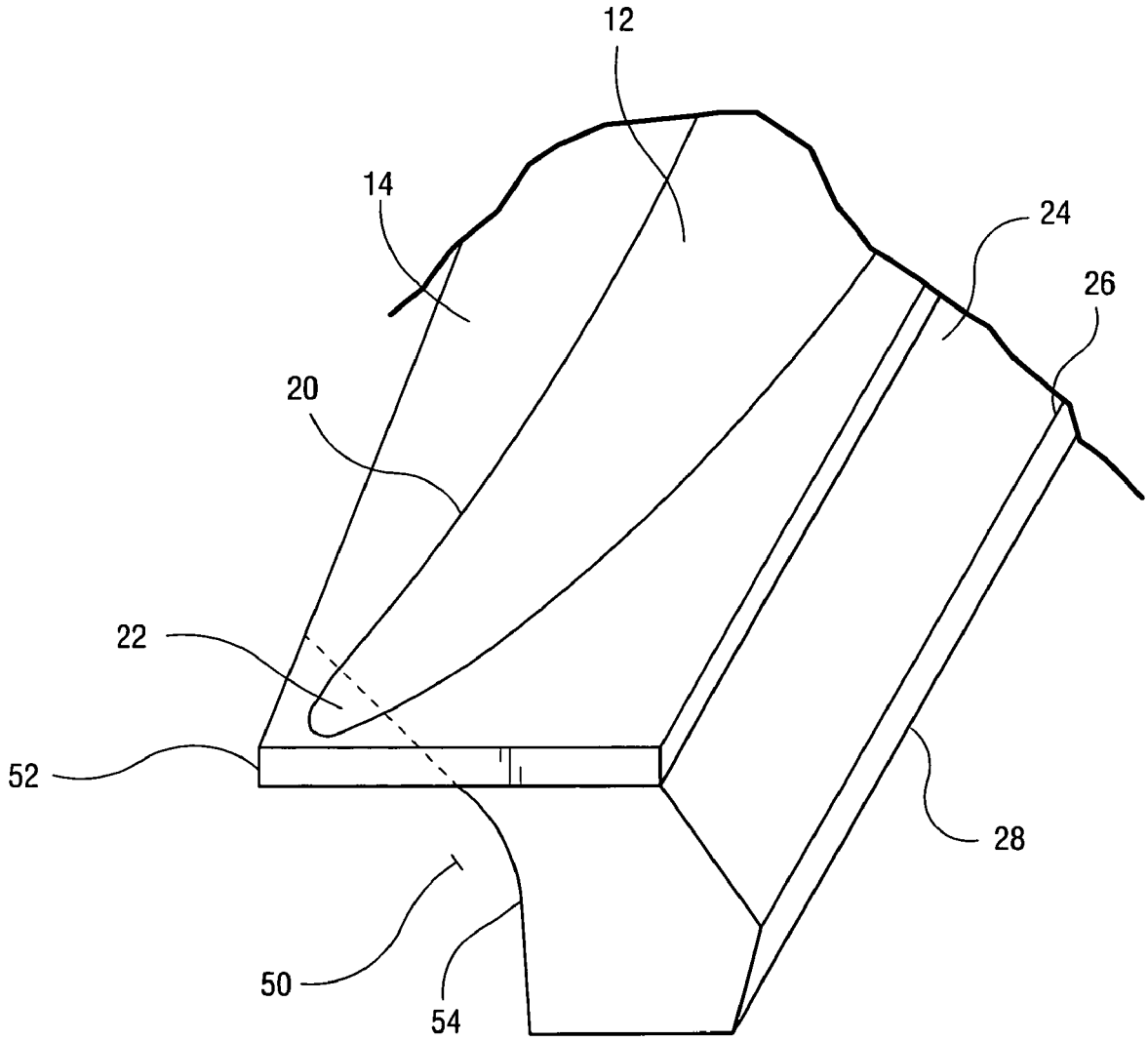
FIG. 3 is a cross-sectional view of another embodiment showing a portion of a dovetail having a removed corner.

In a further alternative embodiment shown in FIG. 3, a corner 50 of the dovetail neck 24 is removed from under the front corner 52 of the platform attached to the leading edge 22 of the airfoil shape. The cut-away section 54 unloads stresses from the leading edge 22 of the blade. Conventional dovetails are generally entirely rectangular in cross-section, and do not include a cut-away section, such as the slot 30 shown in FIGS. 1 and 2 or the removed corner 50 shown in FIG. 3. In FIG. 3, the cut-away section 54 is at a front corner of the dovetail and is below the leading edge 22 of the blade. The cut-away section 54 is also immediately adjacent the front corner 52 of the blade platform 14. The joint 56 between the cut-away section and the bottom of the platform includes a fillet with a generous radius to reduce the stress concentration at the joint.

The cut-away section 54 is removed to unload the front corner of the platform 14 and the blade leading edge 22 near the root 20. The cut-away portion 54 of the dovetail is machined to provide a smooth scalloped surface under the platform.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A gas turbine blade mountable in a disk, said blade comprising:

an airfoil having a leading edge, a trailing edge, opposite airfoil surfaces between the edges, wherein said airfoil has an longitudinal axis extending radially from the disk when the blade is mounted in the disk;

a base attached to and radially inward of the airfoil, wherein said base has opposite end surfaces and opposite side surfaces, and a slot in the base extending across an entirety of one of the end surfaces and projecting into the base to a slot end extending beyond a radial line formed by one of the edges of the airfoil, wherein the slot comprises upper and lower surfaces and the slot end has a substantially constant radius of curvature.

2. A blade as in claim 1 wherein the airfoil comprises a root between the airfoil surfaces and the base.

3. A blade as in claim 1 wherein the one of the edges of the airfoil is the leading edge of the airfoil.

4. A blade as in claim 1 wherein the end portion of the slot extends beyond a line formed by the leading edge of the airfoil.

5. A blade mountable in a disk, said blade comprising:
an airfoil having a leading edge, a trailing edge, opposite airfoil surfaces between the edges, wherein said airfoil has an longitudinal axis extending radially from the disk when the blade is mounted in the disk;
a base attached to and radially inward of the airfoil, wherein said base has opposite end surfaces and opposite side surfaces, and
a slot in the base extending across an entirety of one of the end surfaces and projecting into the base to a slot end extending beyond a radial line formed by one of the edges of the airfoil, wherein the slot comprises upper and lower surfaces, wherein the base comprises a platform and a dovetail, and the slot is in the dovetail.

6. A blade as in claim 5 wherein the slot is in a neck of the dovetail.

7. A blade mountable in a disk, said blade comprising:
an airfoil having a leading edge, a trailing edge, opposite airfoil surfaces between the edges, wherein said airfoil has an longitudinal axis extending radially from the disk when the blade is mounted in the disk;
a base attached to and radially inward of the airfoil, wherein said base has opposite end surfaces and opposite side surfaces, and
a slot in the base extending across an entirety of one of the end surfaces and projecting into the base to a slot end extending beyond a radial line formed by one of the edges of the airfoil, wherein the slot comprises upper and lower surfaces, wherein the end portion of the slot further comprises a curved surface.

8. A blade as in claim 7 wherein the curved surface of the end portion is cylindrical.

9. A blade as in claim 8 wherein the cylindrical end portion has a diameter substantially greater than a distance between the upper and lower surfaces of the slot.

10. A gas turbine blade comprising:
a blade root;
a platform directly fixed to said blade root, said platform having a first side face and a second side face, a first edge face and a second edge face, said first side face being substantially parallel to said second side face and said first edge face being substantially parallel to said second edge face;
an airfoil having a leading edge, a trailing edge, a concave surface and a convex surface, said airfoil fixed to said root and said platform, and extending radially outward from said root and said platform, and
a channel formed in the first edge face of said platform extending from said first side face to said second side face, said channel having a portion having an end portion with a continuous curved surface and the end portion extends into said platform such that said channel crosses a line of stress created by a blade load.

11. The gas turbine blade of claim 10 wherein said portion of said channel having a constant radius of curvature is an end portion of the channel.

12. The gas turbine blade of claim 10 wherein said channel is incorporated in said platform during the blade casting process.

13. The gas turbine blade of claim 10 wherein said channel extends into said platform beyond a line defined by one of said airfoil edges.

14. The gas turbine blade of claim 13 wherein the one of said airfoil edges is the leading edge.

15. The gas turbine blade of claim 10 wherein the platform comprises a platform attached to the airfoil and a dovetail, and the channel is formed in the neck region.

16. The gas turbine blade of claim 10 wherein the platform further comprises a neck region of a dovetail, and the channel is formed in the neck region.

17. A gas turbine blade comprising:
a platform and dovetail combination, said platform and dovetail combination having a first side face and a second side face, a first edge face and a second edge face, said first side face being substantially parallel to said second side face and said first edge face being substantially parallel to said second edge face;
an airfoil having a leading edge, a trailing edge, a concave surface and a convex surface, said airfoil fixed to said platform and extending radially outward from said platform, and
a channel in the first edge face of said platform extending across the first edge face from said first side face to said second side face, said channel having a portion comprising a constant radius of curvature and extending into said platform such that said channel crosses a line of stress created by a blade load.

18. The gas turbine blade of claim 17 wherein said portion of said channel having a constant radius of curvature is an end portion of the channel.

19. The gas turbine blade of claim 17 wherein said channel is incorporated in said platform and dovetail combination during the blade casting process.

20. The gas turbine blade of claim 17 wherein said channel extends into said platform and dovetail combination beyond a line defined by one of said airfoil edges.

21. The gas turbine blade of claim 20 wherein the one of said airfoil edges is the leading edge.

22. The gas turbine blade of claim 17 wherein the platform and dovetail combination further comprises a wide dovetail section having lobes to engage a disk.

23. The gas turbine blade of claim 17 wherein the platform and dovetail combination further comprises a neck region of a dovetail, and the channel is formed in the neck region.

24. A blade of a turbomachine comprising:
an airfoil having a leading edge and a root;
a base attached to the root of the airfoil, and
a slot in the base and generally perpendicular to the airfoil, and said slot extending from a front of the base to a position in the base beyond a line formed by the leading edge and the slot having an end that has a substantially constant radius of curvature.

25. A blade as in claim 24 wherein the blade is an axial compressor blade.

26. A blade as in claim 24 wherein the base further comprises a platform and a dovetail, the airfoil root and edge are attached to a side of the platform, the dovetail is attached to an opposite side of the platform, and the slot is in the neck.

27. A blade of a turbomachine comprising:
an airfoil having a leading edge and a root;
a base attached to the root of the airfoil, and
a slot in the base and generally perpendicular to the airfoil, and said slot extending from a front of the base to a position in the base beyond a line formed by the leading edge, wherein said slot is a key-hole shaped slot, wherein the slot includes an end section with a continuous curved surface.

28. A blade of a turbomachine comprising:
an airfoil having a leading edge and a root;
a base attached to the root of the airfoil, and
a slot in the base and generally perpendicular to the airfoil, and said slot extending from a front of the base to a position in the base beyond a line formed by the leading edge, wherein said slot includes a narrow gap at a front of the slot and a cylindrical aperture at a rear of the slot.

29. A blade of a turbomachine comprising:

an airfoil having a leading edge and a root;

a base attached to the root of the airfoil, and a slot in the base and generally perpendicular to the airfoil, and said slot extending from a front of the base to a position in the base beyond a line formed by the leading edge, wherein the slot has a narrow gap extending from the front of the base and extending to a cylindrical aperture end portion of the slot.

30. A blade as in claim 29 wherein said cylindrical aperture has an axis that is offset from said narrow gap.

31. A gas turbine blade comprising:

a blade root;

a platform directly fixed to said blade root, said platform having a first side face and a second side face, a first edge face and a second edge face, said first side face being substantially parallel to said second side face and said first edge face being substantially parallel to said second edge face;

an airfoil having a leading edge, a trailing edge, a concave surface and a convex surface, said airfoil fixed to said root and said platform, and extending radially outward from said root and said platform, and a channel formed in the first edge face of said platform extending from said first side face to said second side face, said channel having a portion having a constant radius of curvature and extending into said platform such that said channel crosses a line extending axially along the leading edge of the airfoil.

32. The gas turbine blade of claim 31 wherein said portion of said channel having a constant radius of curvature is an end portion of the channel.

33. The gas turbine blade of claim 31 wherein said channel is incorporated in said platform during the blade casting process.

34. The gas turbine blade of claim 31 wherein the platform comprises a platform attached to the airfoil and a dovetail, and the channel is formed in the neck region.

35. The gas turbine blade of claim 31 wherein the platform further comprises a neck region of a dovetail, and the channel is formed in the neck region.

36. A gas turbine blade comprising:

a platform and dovetail combination, said platform and dovetail combination having a first side face and a second side face, a first edge face and a second edge face, said first side face being substantially parallel to said second side face and said first edge face being substantially parallel to said second edge face;

an airfoil having a leading edge, a trailing edge, a concave surface and a convex surface, said airfoil fixed to said platform and extending radially outward from said platform, and a channel in the first edge face of said platform extending across the first edge face from said first side face to said second side face, said channel having a portion comprising a constant radius of curvature and extending into said platform such that said channel crosses an axial line extending from the leading edge.

37. The gas turbine blade of claim 36 wherein said portion of said channel having a constant radius of curvature is an end portion of the channel.

38. The gas turbine blade of claim 36 wherein said channel is incorporated in said platform and dovetail combination during the blade casting process.

39. The gas turbine blade of claim 36 wherein said channel extends into said platform and dovetail combination beyond a line defined by one of said airfoil edges.

* * * * *